US005749695A

United States Patent [19]

Moffett et al.

[11] Patent Number: 5,749,695

[45] Date of Patent: May 12, 1998

[54] FORKLIFT TRUCK MOUNTING FRAME

[75] Inventors: Robert Moffett; Carol Moffett; James McAdam, all of Clontibret; Paul Quinn, Castleblaney; Gerard McHugh, Carrickmacross; Gerard Harte, Castleblaney; Andrew Wylie, Ballybay; Martin McVicar, Killybrone; Thomas Cadden, Monaghan, all of Ireland

[73] Assignee: Moffett Research and Development Limited, Monaghan, Ireland

[21] Appl. No.: 865,931

[22] Filed: May 30, 1997

[30] Foreign Application Priority Data

May 31, 1996 [IE] Ireland ..... 960398

[51] Int. Cl.[6] ..... B66F 9/06

[52] U.S. Cl. ..... 414/467; 414/462

[58] Field of Search ..... 414/467, 462, 414/347, 786, 539, 540, 343; 187/222; 224/281, 400, 401; 280/727; 296/181, 183

[56] References Cited

U.S. PATENT DOCUMENTS 4,396,341 8/1983 Brouwer et al. .
5,575,604 11/1996 Dubosh et al. ..... 414/467 X

FOREIGN PATENT DOCUMENTS 0571240 11/1993 European Pat. Off. .
1491422 1/1976 United Kingdom .
2259292 12/1994 United Kingdom .
2287237 9/1995 United Kingdom .

OTHER PUBLICATIONS

"Dunbar Tico Moffet Mounty".

*Primary Examiner*—Frank E. Werner
*Attorney, Agent, or Firm*—Jacobson, Price, Holman & Stern, PLLC

[57] ABSTRACT

A universal forklift truck mounting frame (1) for fitting at a rear end of a carrier vehicle chassis has a composite base support framework. The base support framework has a rear support beam (8) and a front support beam (20) interconnected by a pair of spaced-apart hanger plates (5). Each hanger plate (5) has a flanged upper end (6) to provide a laterally extending chassis engaging surface. A wheel rest plate (9) is mounted at each end of the rear support beam (8). A pair of fork support sleeves (18), each for engagement with a fork of a forklift truck are mounted on the support framework between and substantially parallel to the hanger plates (5). A crash bar (10) is mounted at a rear end of the hanger plates (5).

19 Claims, 6 Drawing Sheets

FORKLIFT TRUCK MOUNTING FRAME

INTRODUCTION

The present invention relates to a universal mounting frame for fitting to the rear end of carrier vehicles having a chassis comprising at least two spaced apart chassis support beams of variable spacing and above ground heights and for mounting a forklift truck of the type having a pair of front wheels and load supporting forwardly projecting height adjustable forks.

BACKGROUND INFORMATION

Before our invention disclosed in GB Patent No. 2 259 292 B (Moffett) these type of forklift trucks were not in general use, however, the forklift truck disclosed in this GB Patent No. 2 259 292 B (Moffett) has changed materials handling and distribution methods throughout the world. The use of a truck or vehicle mounted forklift allows a driver to load a vehicle, drive to a customer and unload the vehicle without the necessity to use anybody else's materials handling equipment.

Originally, when it was proposed to use forklift trucks in this manner, the type of forklift truck was relatively unsuitable for use in conjunction with carrier vehicles. However, the aforementioned forklift truck disclosed in GB Patent Specification No. 2 259 292 B (Moffett) is a much more compact machine which allows the forklift truck to be mounted on the carrier vehicle without the necessity for specialised vehicles or as is often the case a considerable reduction in the overall vehicle length. Further, since these forklift trucks were relatively few in number, they were usually operated in conjunction with what was essentially specialist carrier vehicles for which specialised and customised mounting brackets for mounting such forklift trucks on the rear of such carrier vehicles were designed.

For example, such a mounting bracket is shown in U.K. Patent No. GB 2 259 292 B (Moffett). These mounting brackets were appropriate in the past when, as mentioned above, generally one forklift was used with one type of carried vehicle. It was, however, long understood that the mounting of the forklift truck on the carrier vehicle was very important.

Because of the more universal use of such forklifts they are now required to be fitted on many types of truck and because of their increased usage, there is a need for a better method of mounting them on the rear of the carrier vehicle chassis without the need to take each vehicle in and fix a special mounting bracket thereto. Unfortunately, however, vehicles are of many different types and sizes and in particular manufacturers of vehicles change the spacing of the chassis, it appears, almost without consideration whatsoever of other uses to which the vehicle may be applied.

The problem of the mounting of forklifts on the rear end of carrier vehicles has indeed been appreciated for some considerable time and there are many examples in the prior art of these mounting frames. For example, in U.S. Pat. No. 4,396,341 (Brouwer) there is a discussion on the various systems that have been developed for mounting forklift trucks on carrier vehicles and this U.S. Patent Specification is directed towards providing a simple mounting means for a forklift truck on a carrier vehicle in which the vibration of travelling is cushioned using the resilience of the front wheels of the forklift truck themselves. However, again this is a specialised system. Such a mounting means requires specific mounting and construction for each specific forklift truck as is the case for example, in U.K. Patent Specification No. GB 1 491 422. Substantially similar mounting frames are described in European Patent Specification No. 0 571 240 A1 (Marrel).

Thus, heretofore, most of the problems with mounting frames of this type which have been addressed, have been the problems of either mounting the frame itself on a particular carrier vehicle, or ensuring that when the frame has been mounted on the carrier vehicles that it adequately supports and retains the forklift truck during transport. However, as mentioned above, these forklift trucks are being used more and more and therefore, not alone is there a need, as suggested in U.S. Pat. No. 4,396,341 (Brouwer) to carry forklift trucks from place to place, because it would be uneconomic to keep a forklift truck at all of the places where it might be used and thus it must be transportable, there is also a need for transporting the forklift truck on a wide range of carrier vehicles. This in turn poses some major problems for the owners and operators of such carrier vehicles. The forklift truck will have to be used with a wide range of vehicles and therefore a wide range of mounting frames will be required. Secondly, such mounting frames must comply with all safety and other vehicle legislation requirements.

When a manufacturer was only fitting a mounting frame to one vehicle on purchase of a forklift truck, the manufacturer was not particularly concerned with either the difficulty in securing the mounting frame to the carrier vehicle or indeed very much to the construction or strength of the mounting frame itself. However, when a purchaser of such a forklift truck intends mounting the forklift truck on a wide range of vehicles to improve the utilisation of the forklift truck, the provision of an efficient and easily assembled and fitted mounting frame becomes vital. The costs of customising a frame to fit a particular vehicle chassis is not that great, when one is only fitting the mounting frame to one vehicle chassis. However, when the mounting frame has to be fitted to a wide range of vehicle chassis other problems arise.

Still further problems arise in that very often the mounting frame will be required to accommodate more than one size of forklift truck as the carrier vehicle may in fact be allocated different forklift trucks by the operator from time to time. Indeed, as a general rule operators are less and less inclined to buy any form of equipment which is not almost instantly usable and are very reluctant to buy equipment that requires them in turn to carry out what they perceive to be relatively major work and particularly which requires a considerable amount of work to be carried out on their vehicles, increasing the down-time of such vehicles.

A further problem has arisen as we all become more safety conscious. Many of the mounting frames proposed heretofore have often projected beyond the rear end of the carrier vehicles which, in the event of an impact from behind, have caused severe damage to the other vehicle. Particularly, for example, where the exposed ends of beams, angles, plates and frame members have been involved in the impact.

While, on the face of it, most of the above would appear obvious it has been discovered that there is a considerable need in industry expressed by those purchasing of such carrier vehicles and forklift trucks for a universal mounting frame that can be fitted to the rear end of the carrier vehicles when such carrier vehicles can have widely differing physical characteristics such as, for example, differently spaced apart chassis support beams, chassis support beams that have a variable height above ground and so on.

OBJECTS

The present invention is directed towards overcoming the difficulties inherent in the present construction of mounting frames for fitting to the rear end of carrier vehicles and in particular to providing an improved construction of such a mounting frame. In addition to providing such a universal mounting frame, the invention is also directed towards providing a mounting frame that will be more efficient in use in being able to accommodate a wide range of forklift trucks and that further will be safer in operation than mounting frames heretofore used.

SUMMARY OF THE INVENTION

According to the invention there is provided a universal mounting frame for fitting to the rear end of carrier vehicles having a chassis comprising at least two spaced apart chassis support beams of variable spacing and above ground heights and for mounting a forklift truck of the type having a pair of front wheels and load supporting forwardly projecting height adjustable forks comprising:

a rear support beam having top and bottom surfaces;

a front support beam having top and bottom surfaces;

a pair of spaced apart hanger plates interconnecting the front and rear support beams to form a composite prefabricated support framework with the bottom surface of one of the support beams spaced apart from the top surface of the other support beam with respect to the hanger plates;

chassis engaging means formed on each hanger plate by cranking the plates intermediate their ends to lie across and above the support framework to provide a longitudinally and laterally extending chassis support beam engaging surface;

a pair of forklift front wheel rest plates mounted in spaced apart relationship on the rear support beam; and a pair of spaced apart hollow socketed support bars for reception of the forks of a forklift truck, each bar rigidly connected to the bottom surface of one support beam and to the top surface of the other support beam and substantially parallel to the hanger plates.

The advantage achieved by the invention is that there is firstly one prefabricated assembly that can be offered up to a wide range of chassis'. The particular construction or the manner in which the hanger plates and the front and rear support beams are juxtaposed, ensures a rigid base framework with considerable structural integrity. Further because the hanger plates are laterally extending as well as longitudinally extending, they can accommodate many widths of chassis. It will be appreciated that the arrangement of the hollow socketed support bars for reception of the forks of a forklift trucks where each bar is rigidly connected to the bottom surface of one support beam and to the top surface of the other support beam, is a particularly advantageous construction in providing additional rigidity to the framework and also making it more resistant to torsional stresses as well as deterioration under vibration. This is particularly useful in that it will prevent flexing of the framework giving added rigidity to the vehicle chassis, which vehicle chassis is now experiencing a loading that it may not necessarily have been designed for. It is thus very important to ensure that not alone is the mounting framework sufficiently rigid to support the forklift truck, but must also take account of the chassis stresses since there would be no advantage if a sufficiently rigid mounting frame which retained its own structural integrity while destroying that of the carrier vehicle chassis to which it is mounted.

In an alternative embodiment of the invention there is mounted a laterally projecting crash bar between the hanger plates so as to be behind the wheel rest plates on the side of the rear support beam remote from the front support beam. The advantage of using a crash bar will be self-evident, but additionally the advantage of using a crash bar which is incorporated in a composite prefabricated mounting frame is that it will provide an even more rigid framework as well as performing it's primary function of protecting other vehicles in the event of a crash. This composite crash bar support framework construction will ensure that on a crash occurring, the chassis is less likely to be damaged and distorted, than would be the case if the crash bar was simply mounted on the chassis itself. By ensuring that the mounting frame also incorporates a crash bar there is a very structurally secure mounting frame that will ensure in the event of a crash that it is the support framework carrying the crash bar, namely the mounting frame that takes the impact of the load, rather than the vehicle chassis itself. Also by having the crash bar so positioned, there is less likelihood of the mounting frame causing damage to third parties.

In another embodiment of the invention there is provided a laterally extending crash bar comprising:

a central body portion rigidly mounted between the hanger plates so as to be behind the wheel rest plates on the side of the rear support beam remote from the front support beam;

an outer end portion pivotally mounted adjacent each free end of the central body portion; and locking means for releasably securing the outer end portions in an extended operative position in-line with the central body portion or in a stored folded position to allow access to the wheel rest plates.

The advantage of this construction is that the crash bar can be mounted rearwardly of all the mounting frame, without the necessity of having to provide pivoting rest plates to carry the wheels of the forklift truck, or indeed to in some way arrange those plates as to be permanently behind the crash bar and at the same time be accessible for mounting a forklift truck's wheels on them. Thus, when the forklift truck is mounted on the carrier vehicle the crash bar, or at least that portion of it that is likely to interfere with the forklift truck can be pivoted out of the way and it is now the rear of the forklift truck that provides what is, in effect, the crashbar.

In a particularly suitable embodiment of the invention there is provided a laterally projecting crash bar comprising:

a central hollow socketed body portion rigidly mounted between the hanger plates so as to lie behind the wheel rest plates on the side of the rear support beam remote from the front support beam; and an outer end portion slidable within the central body portion at each free end thereof, between an extended operative position and a nested stored position allowing access to the wheel rest plates.

The advantage of this is that there is no need to provide any locking system. The crash bar can be pulled in and out of position or at least that portion of the crash bar that would cause difficulty in relation to accommodating the forklift truck can be moved easily in and out of position.

Ideally each wheel rest plate is adjustably mounted on the rear support beam for adjustment of the spacing between the wheel rest plates. The advantage of this is that now many different sizes and widths of forklift trucks can be accommodated.

Further, in one embodiment of the invention each wheel rest plate comprises:

a sleeve member slidably mounted on the rear support beam;

a plate rigidly secured to the sleeve; and a wheel stop slidably mounted on the front support beam.

This again is a particularly suitable construction since when the rest plate is slidably mounted on the rear support beam, there is no need for any precise adjustment of the spacing of the rest plates. They can be moved together or apart as is required to accommodate the particularly forklift truck.

The invention further provides a universal mounting frame for fitting to the rear end of carrier vehicles having a chassis comprising at least two spaced apart chassis support beams of variable spacing and above ground heights and for mounting a forklift truck of the type having a pair of front wheels and load supporting forwardly projecting height adjustable forks comprising:

a rear support beam having top and bottom surfaces;

a front support beam having top and bottom surfaces;

a pair of spaced apart hanger plates interconnecting the front and rear support beams to form a composite prefabricated support framework with the bottom surface of one of the support beams spaced apart from the top surface of the other support beam with respect to the hanger plates;

chassis engaging means formed on each hanger plate by cranking the plates intermediate their ends to lie across and above the support framework to provide a longitudinally and laterally extending chassis support beam engaging surface;

a pair of forklift front wheel rest plates mounted in spaced apart relationship on the rear support beam;

a pair of spaced apart hollow socketed support bars for reception of the forks of a forklift truck, each bar rigidly connected to the bottom surface of one support beam and to the top surface of the other support beam and substantially parallel to the hanger plates; and a laterally projecting crash bar between the hanger plates so as to be behind the wheel rest plates on the side of the rear support beam remote from the front support beam.

What has to be appreciated about this particularly construction of universal mounting frame is that it is of its very nature a totally rigid structure, which has two advantages in that firstly it provides adequate protection for the chassis of the carrier vehicle in the event of impact occurring, whether it be impact directly onto the crash bar itself which is incorporated within the mounting frame or onto a forklift truck being carried by the vehicle. Having a mounting frame with an integral crash bar ensures that the crashbar will always be used and that the mounting frame cannot be used without it and thus there is additional safety. These, together with the need to be able to mount such a mounting frame on a wide range of vehicles are the three most important features of the invention, namely, adaptability, rigidity of construction and safety.

In one preferred embodiment of the invention the crash bar is collapsible and comprises:

a central body portion rigidly mounted between the hanger plates; and an outer end portion pivotally mounted adjacent each free end of the central body portion.

This is a particularly simple construction that allows the crash bar to be configured in such a way as to avoid any possibility of interfering with the mounting of the forklift truck on the carrier vehicle.

In a modification of this embodiment there is provided locking means for releasably securing the outer end portions in an extended operative position in-line with the central body portion or in a stored folded position to allow access to the wheel rest plates. It will be well appreciated that providing locking means is useful in that these locking means do not have to be particularly sophisticated in construction. For example, if the bar is pivoted, then the locking means can simply be a pin which can engage both the central body portion and the outer end portion to prevent mutual movement.

In a still further embodiment of the invention, the crash bar comprises:

a central hollow socketed body portion rigidly mounted between the hanger plates; and an outer end portion slidable within the central body portion at each free end thereof, between an extended operative position and a nested stored position allowing access to the wheel rest plates.

The advantage of this is obviously that there is no need to provide any form of locking. The outer end portion can be a relatively loose fit in the central hollow socket body portion, thus facilitating manufacture and ease of use, because even if the crash bar in use sustains an impact, it is quite likely that the outer end portion will still slide within the central hollow socketed body portion unless considerable damage has been done to one or the other.

In a still further embodiment of the invention each wheel rest plate is slidably mounted on the rear support beam for adjustment of the spacing between the wheel rest plates. The advantage of this is that it can accommodate many forms of forklift truck and is thus particularly advantageous.

In a still further embodiment of the invention when each wheel rest plate is adjustably mounted on the rear support beam, there is provided an associated stop member mounted adjacent a front end of the rest wheel. By doing this it is possible to provide stop members that will be contoured to accommodate the shape of the wheel or so arranged as to form a socket within which the wheel may partly rest and will in any case form another surface against which the wheel will rest so that the vibrations experienced by the forklift truck during travel will be transmitted to the pneumatic tires of the wheel of the forklift truck further reducing the possibility of damage to the forklift truck from this vibration and similarly to both the mounting frame and the vehicle chassis in that any vibration emanating from the forklift truck will be dampened. It also provides a more rigid mounting of the forklift truck on the mounting frame which will in turn prevent the forklift truck from bouncing around during transport.

Further the invention provides in combination:

a forklift truck comprising:

a chassis;

a pair of front wheels mounted on the chassis;

a pivotal rear wheel mounted on the chassis;

a steering mechanism connected to the rear wheel;

drive means on the chassis for driving at least one wheel;

an upright mast pivotally mounted about a transverse axis on the chassis between the two front wheels;

actuator means connected to the upright mast for tilting of the mast about the transverse axis;

a pair of load supporting spaced apart forwardly projecting forks on the mast; and drive means on the mast for raising and lowering the forks;

a carrier vehicle having a chassis comprising at least two spaced apart chassis support beams; and a mounting frame comprising:

a rear support beam having top and bottom surfaces;

a front support beam having top and bottom surfaces;

a pair of spaced apart hanger plates interconnecting the front and rear support beams to form a composite prefabricated support framework with the bottom surface of one of the support beams spaced apart from the top surface of the other support beam with respect to the hanger plates;

chassis engaging means formed on each hanger plate by cranking the plates intermediate their ends to lie across and above the support framework to provide a longitudinally and laterally extending chassis support beam engaging surface;

a pair of forklift front wheel rest plates mounted in spaced apart relationship on the rear support beam;

a pair of spaced apart hollow socketed support bars for reception of the forks of a forklift truck, each bar rigidly connected to the bottom surface of one support beam and to the top surface of the other support beam and substantially parallel to the hanger plates; and a laterally projecting crash bar between the hanger plates so as to be behind the wheel rest plates on the side of the rear support beam remote from the front support beam.

It has to be appreciated that this particular combination is a very advantageous way of providing a forklift truck and carrier vehicle, which together form a composite unit which is both economical to operate and safe to provide.

In another embodiment of combination a mounting frame in which the crash bar is collapsible and comprises:

a central body portion rigidly mounted between the hanger plates; and an outer end portion pivotally mounted adjacent each free end of the central body portion.

In a further embodiment of the combination a mounting frame in which the crash bar is collapsible and comprises:

a central body portion rigidly mounted between the hanger plates;

an outer end portion pivotally mounted adjacent each free end of the central body portion; and locking means for releasably securing the outer end portions in an extended operative position in-line with the central body portion or in a stored folded position to allow access to the wheel rest plates.

In another embodiment of the combination a mounting frame in which the crash bar comprises:

a central hollow socketed body portion rigidly mounted between the hanger plates; and an outer end portion slidable within the central body portion at each free end thereof, between an extended operative position and a nested stored position allowing access to the wheel rest plates.

In another embodiment of the combination a mounting frame in which each wheel rest plate is slidably mounted on the rear support beam for adjustment of the spacing between the wheel rest plates.

In a further embodiment of the combination a mounting frame in which each wheel rest plate is adjustably mounted on the rear support beam for adjustment of the spacing between the wheel rest plates and in which each wheel rest plate has an associated stop member mounted adjacent a front end of the rest wheel.

BRIEF DESCRIPTION OF THE DRAWINGS

Other features and advantages of the invention will be apparent from the following description given in connection with the accompanying drawings wherein.

DESCRIPTION OF THE PREFERRED EMBODIMENTS

Figure 7:
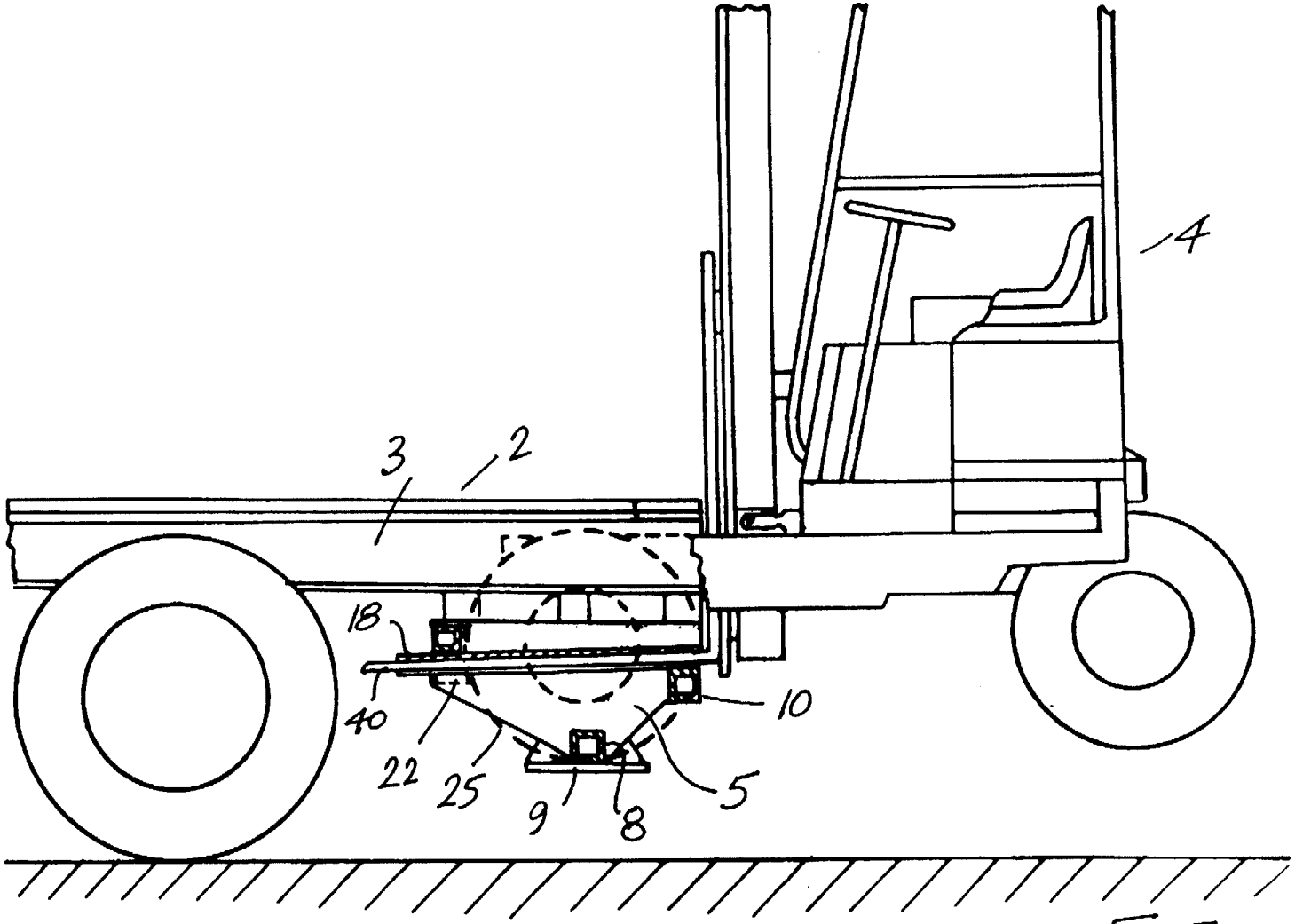
FIG. 7 is a side partially sectioned elevational view showing the rear end of the carrier vehicle with the mounting frame in use carrying a forklift truck.

Referring to the drawings there is illustrated a universal mounting frame according to the invention indicated generally by the reference numeral 1. The universal mounting frame 1 is for mounting at a rear end of a carrier vehicle 2 (FIG. 5) being suspended from longitudinal beams 3 on the chassis of the carrier vehicle 2. A forklift truck 4 (FIG. 7) is engagable with the universal mounting frame 1 to mount the forklift truck 4 on the carrier vehicle 2 for transport and will be described in more detail below.

The universal mounting frame 1 has a composite prefabricated base support framework comprising a pair of spaced-apart substantially upright hanger plates 5 of generally triangular configuration with a substantially horizontal flange 6 at an upper end of each hanger plate 5. A front support beam 20 is mounted at a front end of the hanger plates 5 and a rear support beam 8 extends between a lower end of each hanger plate 5 and projects outwardly therefrom. A wheel rest plate 9 is mounted at each outer end of the support beam 8.

A crash bar 10 is mounted at a rear end of the hanger plates 5. Outer ends 11,12 of the crash bar 10 are foldable between a stored position alongside the hanger plates 5 and an extended position in line with a central body portion 13 of the crash bar 10. Each outer portion 11,12 carries indicating and brake lamps 14 for the carrier vehicle 2.

Figure 5:
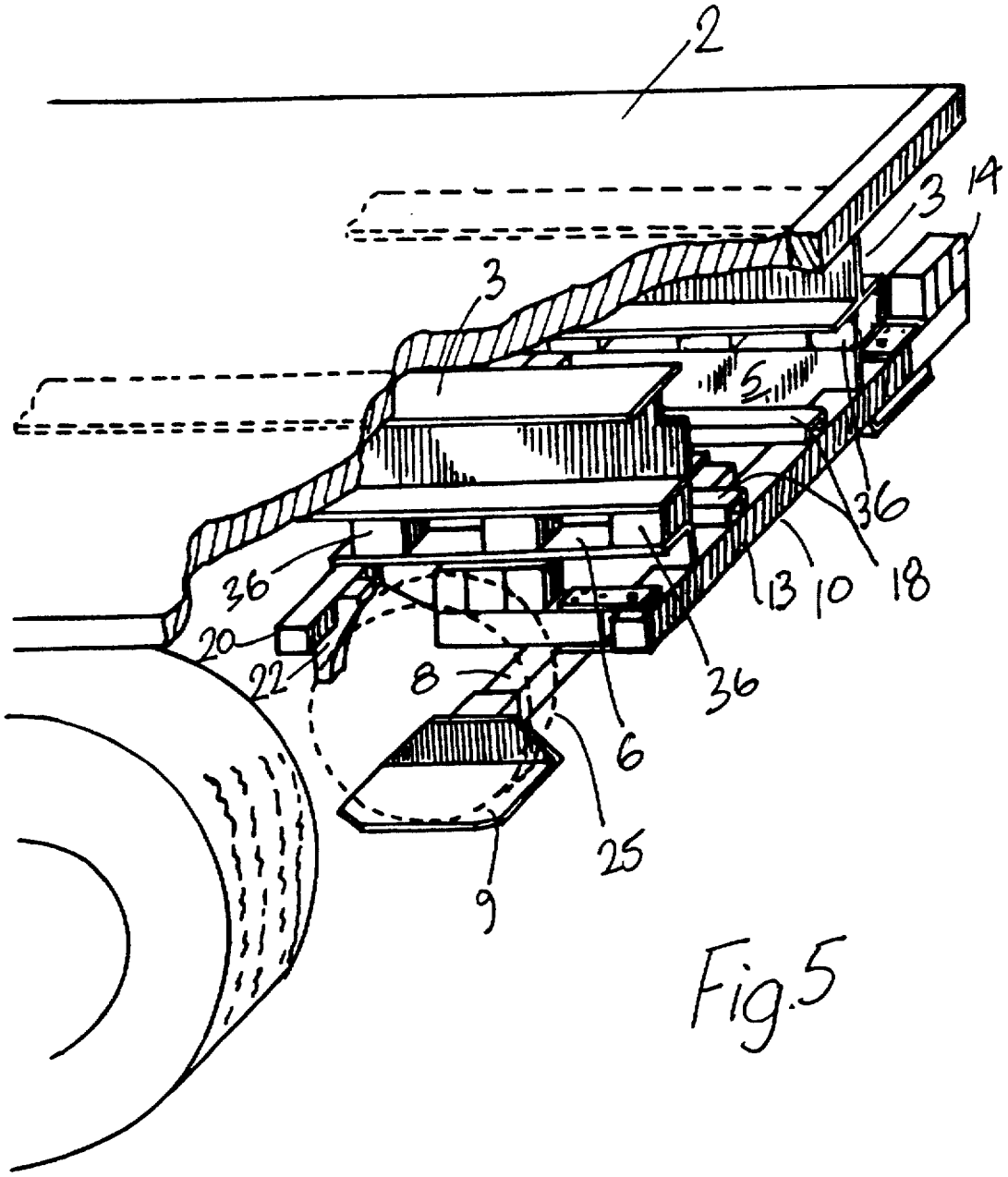
FIG. 5 is a perspective view of the universal mounting frame, shown mounted at the rear end of a carrier vehicle.
Figure 6:
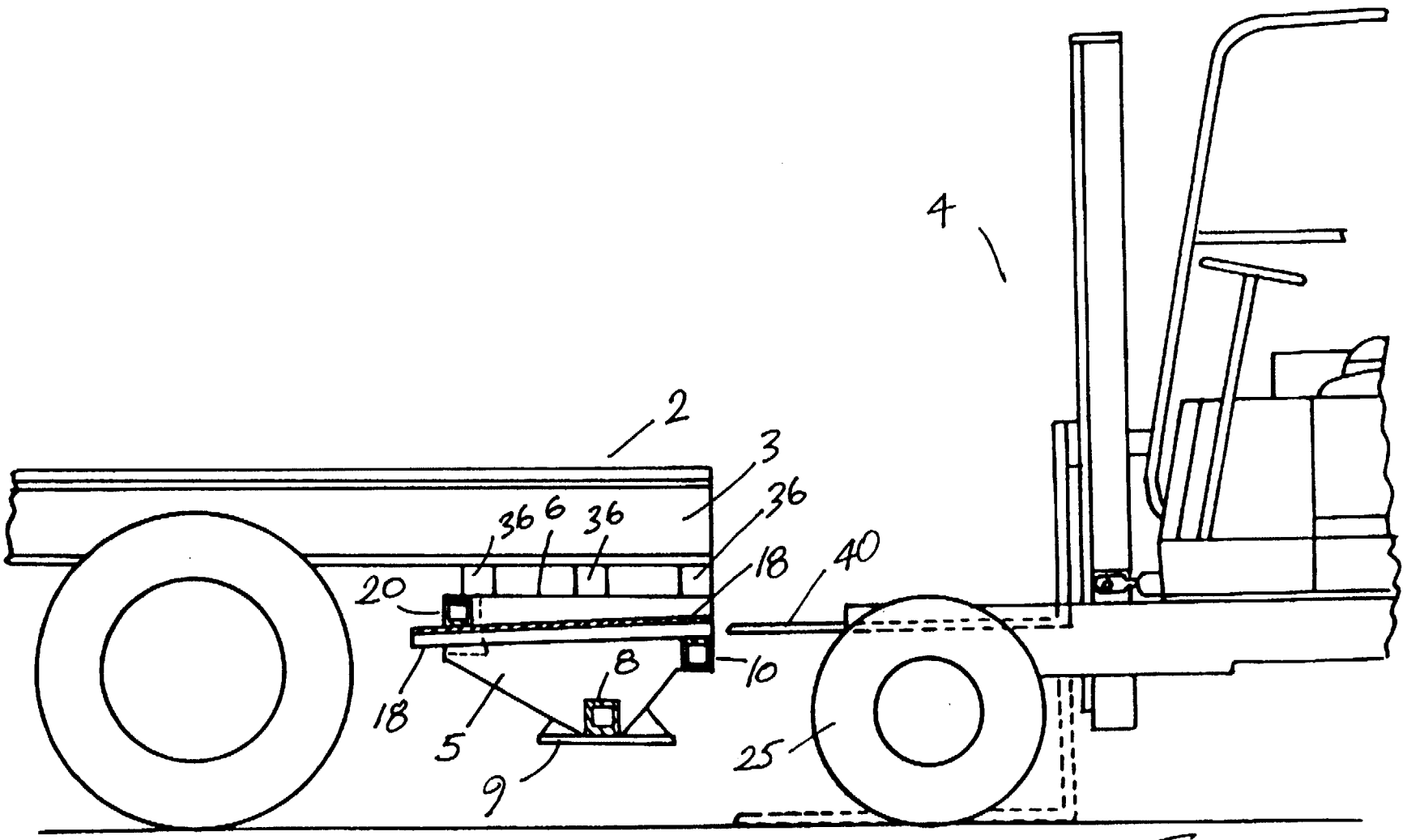
FIG. 6 is a side partially sectioned elevational view showing the rear end of the carrier vehicle with the universal mounting frame attached.

A pair of spaced-apart fork support bars or sleeves 18 are mounted between the crash bar 10 and the front support beam 20 extending between the hanger plates 5 at a front end of the hanger plates 5. Wheel stops 22 associated with each wheel rest plate 9 are mounted adjacent each outer end of the front support beam 20. Thus as shown in FIG. 5 when a wheel 25 (shown in broken outline) of a forklift truck is seated on the wheel rest plate 9, a front end of the wheel 25 engages against the wheel stop 22.

Figure 1:
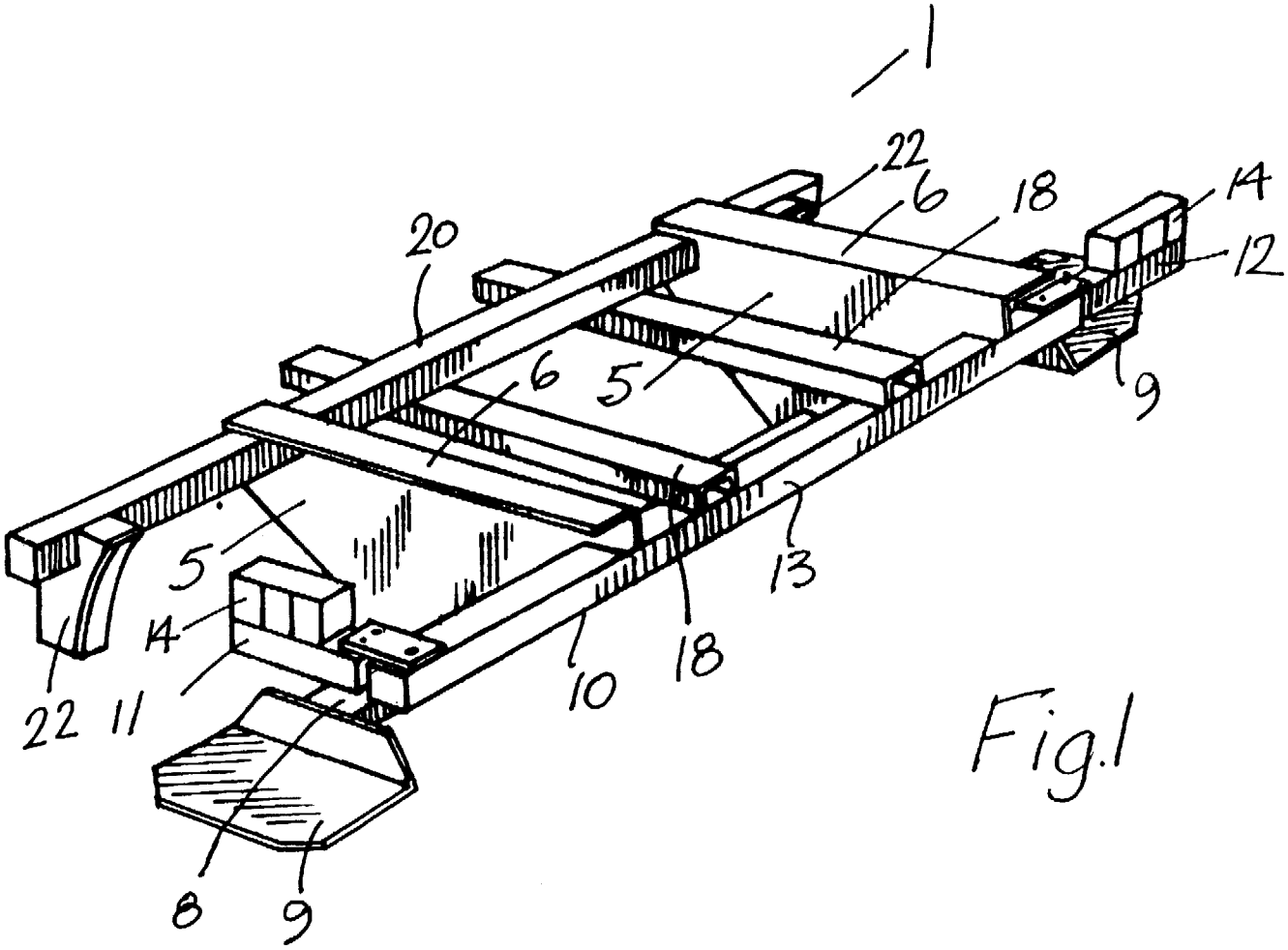
FIG. 1 is a perspective view of a universal mounting frame according to the invention.
Figure 3:
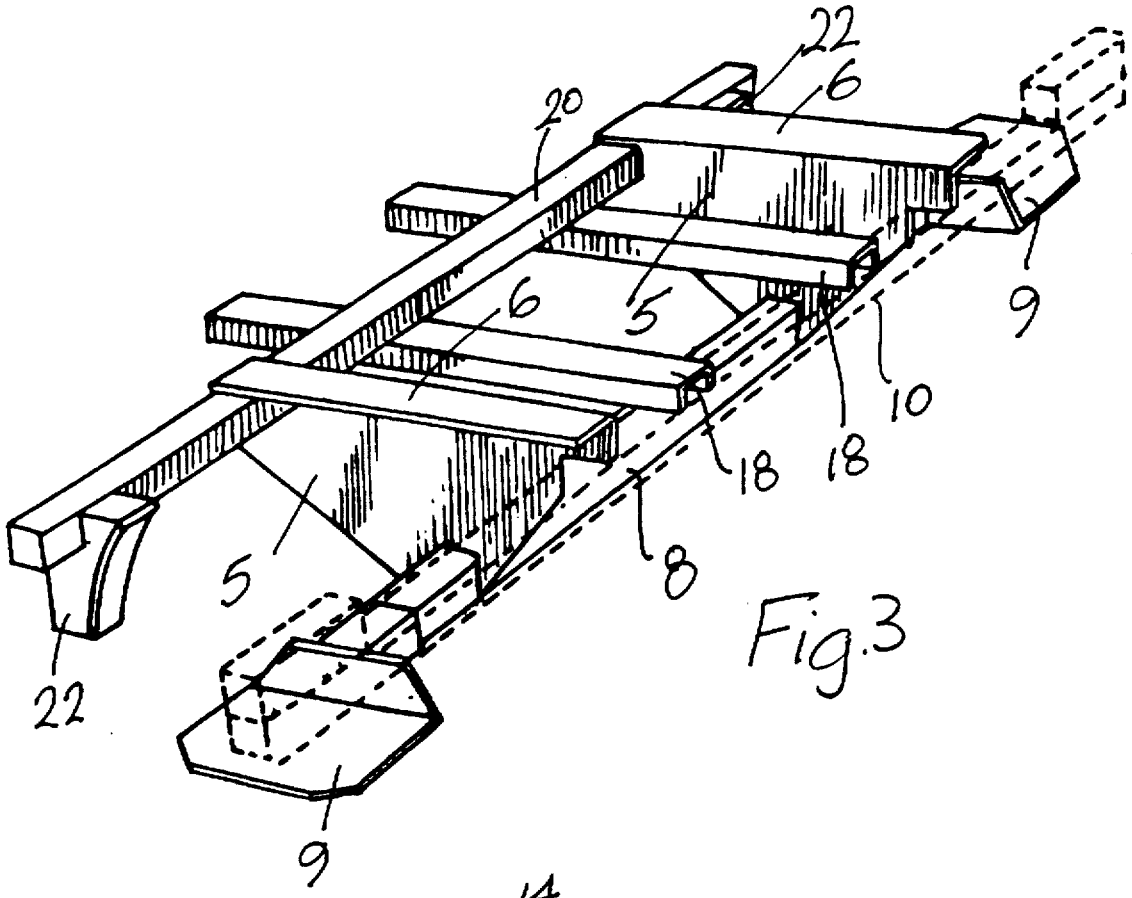
FIG. 3 is a view similar to FIG. 1 with a crash bar portion of the universal mounting frame shown in broken outline.
Figure 2:
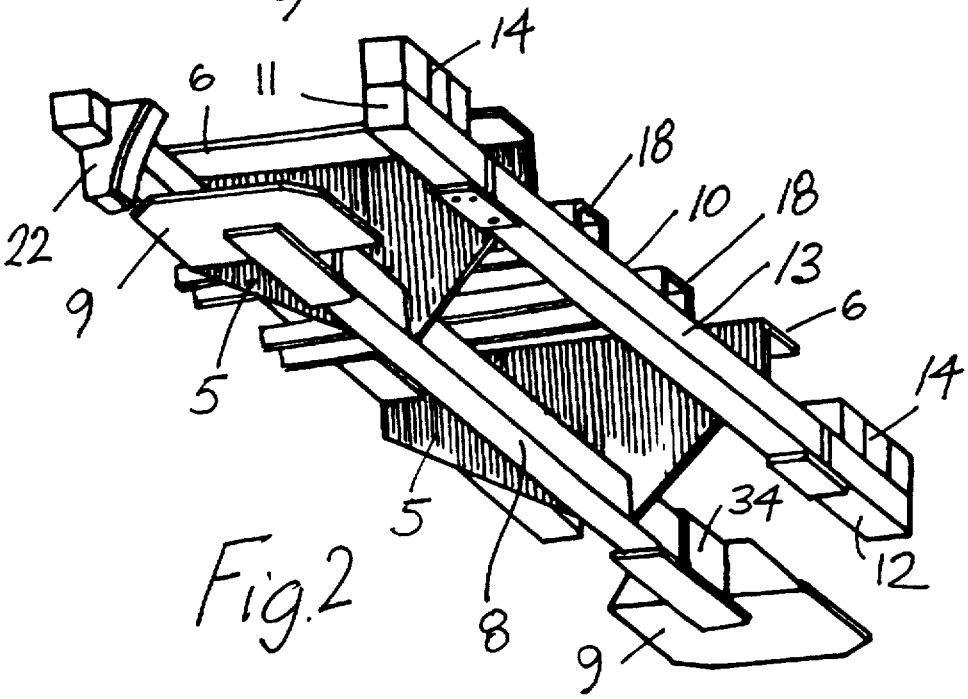
FIG. 2 is an underneath perspective view of the universal mounting frame.
Figure 4:
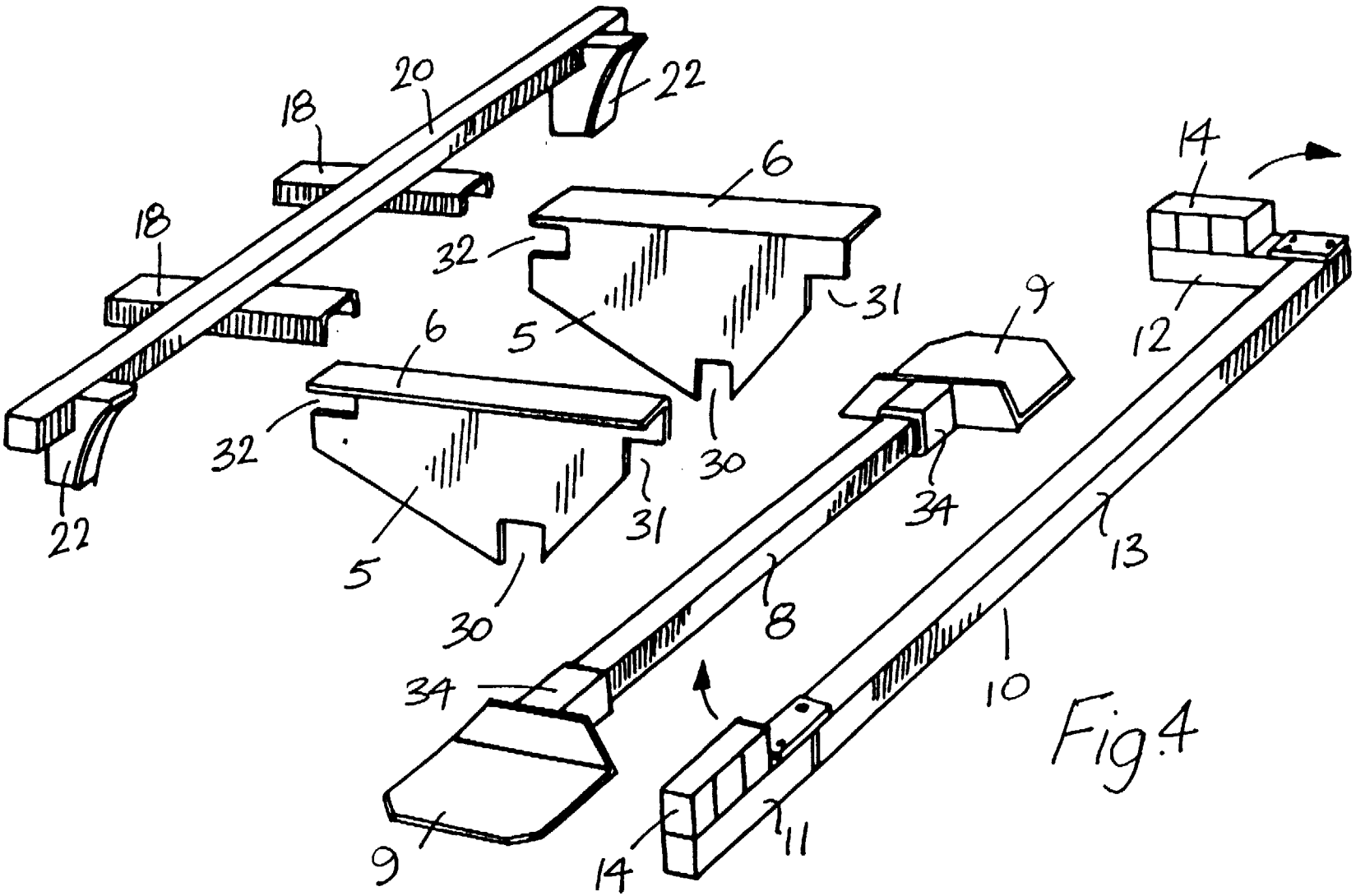
FIG. 4 is an exploded view of the universal mounting frame.

FIG. 4 shows an exploded inverted view of the universal mounting frame 1. Hanger plates 5 are formed with slots 30,31,32 for reception of the rear support beam 8, crash bar 10 and front support beam 20 respectively. The rear support beam 8 which is of box section material is inserted into the slots 30 and with the hanger plates 5 spaced-apart a preset desirable distance and in generally parallel alignment, the rear support beam 8 is welded to the hanger plates 5.

The wheel rest plates 9 each have a sleeve 34 which slidably engages an outer end of the rear support beam 8. Thus, the spacing between the wheel rest plates 9 can be adjusted to a required distance and then the wheel rest plates 9 are fixed in position by welding. In some cases, it may be desirable to leave the wheel rest plates 9 permanently adjustable on the rear support beam 8 to accommodate use of different forklift trucks with the carrier vehicle 2. The crash bar 10 and front support beam 20 are inserted in their associated slots 31, 32 respectively and welded in position.

Each of the fork sleeves 18 is then mounted spaced-apart between the crash bar 10 and front support beam 20 and welded in position. It will be noted that the fork sleeves 18 rest on a top surface of the crash bar 10 and engage an underside of the front support beam 20. The front support beam 20 in turn is located within cut-out slots at a front end of the hanger plates 5. This construction gives a strong and rigid structure which resists the tendency of the front ends of the fork sleeves 18 to lift due to the cantilevered effect of the forklift truck 4 when raising the forklift truck 4 on to the universal mounting frame 1.

In use, the universal mounting frame 1 is mounted at a rear end of a carrier vehicle 2 or trailer. Spacers 36 may be mounted between longitudinal beams 3 of the goods vehicle 2 and the flanges 6 of the hanger plates 5 for height adjustment of the universal mounting frame 1 on the carrier vehicle chassis. A forklift truck 4 can engage its forks 40 in the sleeves 18 to raise itself and engage front wheels 25 of the forklift truck 4 with the wheel rest plates 9. Straps, chains or ties (not shown) are then engaged between the body of the forklift truck 4 and lugs at a rear end of the carrier vehicle 2 to secure the forklift truck 4 in position carried on the wheel rest plates 9 held forwardly against the wheel stops 22. The fork controls can then be operated to take the weight of the forklift truck 4 off the forks so that the universal mounting frame 1 carries the forklift through the wheel rest plates 9.

It will be appreciated that the universal mounting frame 1 can be readily easily prefabricated and then simply attached to a chassis at a rear end of a carrier vehicle or trailer. Typically these carrier vehicles and trailers have a pair of spaced-apart longitudinal beams, and the spacing between the beams may vary between different sizes and constructions of vehicle. The flanged upper end of the hanger plates accommodates a range of sizes and the hanger plates may be mounted directly onto the beams on the carrier vehicle or spacers or mounting brackets may be provided to attach the upper end of the hanger plates to the longitudinal beams of the carrier vehicle chassis.

With regard to the crash bar, the collapsing of the crash bar may be achieved in a number of ways. The outer ends of the crash bar may be horizontally foldable as described above. In some cases, the outer ends may be vertically foldable. Alternatively, the outer ends could be telescopically retractable within the central body portion or even removably mounted on the central body portion.

The invention is not limited to the embodiments hereinbefore described which may be varied in both construction and detail.

We claim:

1. A universal mounting frame for fitting to a rear end of carrier vehicles having a chassis comprising at least two spaced apart chassis support beams of variable spacing and above ground heights and for mounting a forklift truck of a type having a pair of front wheels and load supporting forwardly projecting height adjustable forks comprising:

a rear support beam having top and bottom surfaces;

a front support beam having top and bottom surfaces;

a pair of spaced apart hanger plates interconnecting the front and rear support beams to form a composite prefabricated support framework with the bottom surface of one of the support beams spaced apart from the top surface of the other support beam with respect to the hanger plates;

chassis engaging means formed on each hanger plate by cranking the plates intermediate their ends to lie across and above the support framework to provide a longitudinally and laterally extending chassis support beam engaging surface;

a pair of forklift front wheel rest plates mounted in spaced apart relationship on the rear support beam; and a pair of spaced apart hollow socketed support bars for reception of the forks of a forklift truck, each bar rigidly connected to the bottom surface of one support beam and to the top surface of the other support beam and substantially parallel to the hanger plates.

2. A universal mounting frame as claimed in claim 1 in which there is mounted a laterally projecting crash bar between the hanger plates so as to be behind the wheel rest plates on the side of the rear support beam remote from the front support beam.

3. A universal mounting frame as claimed in claim 1 in which there is provided a laterally projecting crash bar comprising:

a central body portion rigidly mounted between the hanger plates so as to be behind the wheel rest plates on the side of the rear support beam remote from the front support beam;

an outer end portion pivotally mounted adjacent each free end of the central body portion; and locking means for releasably securing the outer end portions in an extended operative position in-line with the central body portion or in a stored folded position to allow access to the wheel rest plates.

4. A universal mounting frame as claimed in claim 1 in which there is provided a laterally projecting crash bar comprising:

a central hollow socketed body portion rigidly mounted between the hanger plates so as to lie behind the wheel rest plates on the side of the rear support beam remote from the front support beam; and an outer end portion slidable within the central body portion at each free end thereof, between an extended operative position and a nested stored position allowing access to the wheel rest plates.

5. A universal mounting frame as claimed in claim 1 in which each wheel rest plate is adjustably mounted on the rear support beam for adjustment of the spacing between the wheel rest plates.

6. A universal mounting frame as claimed in claim 1 in which each wheel rest plate comprises:

a sleeve member slidably mounted on the rear support beam;

a plate rigidly secured to the sleeve; and a wheel stop slidably mounted on the front support beam.

7. A universal mounting frame for fitting to a rear end of carrier vehicles having a chassis comprising at least two spaced apart chassis support beams of variable spacing and above ground heights and for mounting a forklift truck of a type having a pair of front wheels and load supporting forwardly projecting height adjustable forks comprising:

a rear support beam having top and bottom surfaces;

a front support beam having top and bottom surfaces;

a pair of spaced apart hanger plates interconnecting the front and rear support beams to form a composite prefabricated support framework with the bottom surface of one of the support beams spaced apart from the top surface of the other support beam with respect to the hanger plates;

chassis engaging means formed on each hanger plate by cranking the plates intermediate their ends to lie across and above the support framework to provide a longitudinally and laterally extending chassis support beam engaging surface;

a pair of forklift front wheel rest plates mounted in spaced apart relationship on the rear support beam;

a pair of spaced apart hollow socketed support bars for reception of the forks of a forklift truck, each bar rigidly connected to the bottom surface of one support beam and to the top surface of the other support beam and substantially parallel to the hanger plates; and a laterally projecting crash bar between the hanger plates so as to be behind the wheel rest plates on the side of the rear support beam remote from the front support beam.

8. A universal mounting frame as claimed in claim 7 in which the crash bar is collapsible and comprises:

a central body portion rigidly mounted between the hanger plates; and an outer end portion pivotally mounted adjacent each free end of the central body portion.

9. A universal mounting frame as claimed in claim 7 in which the crash bar is collapsible and comprises:

a central body portion rigidly mounted between the hanger plates;

an outer end portion pivotally mounted adjacent each free end of the central body portion; and locking means for releasably securing the outer end portions in an extended operative position in-line with the central body portion or in a stored folded position to allow access to the wheel rest plates.

10. A universal mounting frame as claimed in claim 7 in which the crash bar comprises:

a central hollow socketed body portion rigidly mounted between the hanger plates; and an outer end portion slidable within the central body portion at each free end thereof, between an extended operative position and a nested stored position allowing access to the wheel rest plates.

11. A universal mounting frame as claimed in claim 7 in which each wheel rest plate is adjustably mounted on the rear support beam for adjustment of the spacing between the wheel rest plates.

12. A universal mounting frame as claimed in claim 7 in which each wheel rest plate is slidably mounted on the rear support beam for adjustment of the spacing between the wheel rest plates.

13. A universal mounting frame as claimed in claim 7 in which each wheel rest plate is adjustably mounted on the rear support beam for adjustment of the spacing between the wheel rest plates and in which each wheel rest plate has an associated stop member mounted adjacent a front end of the rest wheel.

14. In combination:

a forklift truck comprising:

a chassis;

a pair of front wheels mounted on the chassis;

a pivotal rear wheel mounted on the chassis;

a steering mechanism connected to the rear wheel;

drive means on the chassis for driving at least one wheel;

an upright mast pivotally mounted about a transverse axis on the chassis between the two front wheels;

actuator means connected to the upright mast for tilting of the mast about the transverse axis;

a pair of load supporting spaced apart forwardly projecting forks on the mast; and drive means on the mast for raising and lowering the forks;

a carrier vehicle having a chassis comprising at least two spaced apart chassis support beams; and a mounting frame comprising:

a rear support beam having top and bottom surfaces;

a front support beam having top and bottom surfaces;

a pair of spaced apart hanger plates interconnecting the front and rear support beams to form a composite prefabricated support framework with the bottom surface of one of the support beams spaced apart from the top surface of the other support beam with respect to the hanger plates;

chassis engaging means formed on each hanger plate by cranking the plates intermediate their ends to lie across and above the support framework to provide a longitudinally and laterally extending chassis support beam engaging surface;

a pair of forklift front wheel rest plates mounted in spaced apart relationship on the rear support beam;

a pair of spaced apart hollow socketed support bars for reception of the forks of a forklift truck, each bar rigidly connected to the bottom surface of one support beam and to the top surface of the other support beam and substantially parallel to the hanger plates; and a laterally projecting crash bar between the hanger plates so as to be behind the wheel rest plates on the side of the rear support beam remote from the front support beam.

15. In a combination as claimed in claim 14 a mounting frame in which the crash bar is collapsible and comprises:

a central body portion rigidly mounted between the hanger plates; and an outer end portion pivotally mounted adjacent each free end of the central body portion.

16. In a combination as claimed in claim 14 a mounting frame in which the crash bar is collapsible and comprises:

a central body portion rigidly mounted between the hanger plates;

an outer end portion pivotally mounted adjacent each free end of the central body portion; and locking means for releasably securing the outer end portions in an extended operative position in-line with the central body portion or in a stored folded position to allow access to the wheel rest plates.

17. In a combination as claimed in claim 14 a mounting frame in which the crash bar comprises:

a central hollow socketed body portion rigidly mounted between the hanger plates; and an outer end portion slidable within the central body portion at each free end thereof, between an extended operative position and a nested stored position allowing access to the wheel rest plates.

18. In a combination as claimed in claim 14 a mounting frame in which each wheel rest plate is slidably mounted on the rear support beam for adjustment of the spacing between the wheel rest plates.

19. In a combination as claimed in claim 14 a mounting frame in which each wheel rest plate is adjustably mounted on the rear support beam for adjustment of the spacing between the wheel rest plates and in which each wheel rest plate has an associated stop member mounted adjacent a front end of the rest wheel.

* * * * *